US005328282A

United States Patent [19]

Charrier et al.

[11] Patent Number: 5,328,282

[45] Date of Patent: Jul. 12, 1994

[54] COMBINED MASCARA BOTTLE AND APPLICATOR

[75] Inventors: Jacqueline W. Charrier, Hunt Valley, Md.; Mark P. McNally, Cincinnati, Ohio

[73] Assignee: The Procter & Gamble Company, Cincinnati, Ohio

[21] Appl. No.: 6,563

[22] Filed: Jan. 21, 1993

[51] Int. Cl.[5] ..... A45D 34/00; A45D 40/00

[52] U.S. Cl. ..... 401/4; 401/127; 401/129

[58] Field of Search ..... 401/4, 127, 129; 132/218

[56] References Cited

U.S. PATENT DOCUMENTS

| | | | |
|---|---|---|---|
| 3,115,664 | 12/1963 | Del Ponte | 401/4 |
| 3,209,387 | 10/1965 | Lukesch | 401/4 |
| 3,529,899 | 9/1970 | Gruska | 401/127 X |
| 4,165,755 | 8/1979 | Cassai | 132/88.7 |
| 4,219,283 | 8/1980 | Buckley et al. | 401/127 X |
| 4,428,388 | 1/1984 | Cassai et al. | 132/88.7 |
| 4,598,723 | 7/1986 | Cole | 132/218 |
| 4,690,579 | 9/1987 | Tuckman | 401/127 |
| 4,984,920 | 1/1991 | O'Neil | 401/127 |
| 5,121,763 | 1/1992 | Kingsford | 132/317 |
| 5,137,038 | 8/1992 | Kingsford | 132/218 |

*Primary Examiner*—Steven A. Bratlie
*Attorney, Agent, or Firm*—Kevin C. Johnson; Ronald L. Hemingway; E. Kelly Linman

[57] ABSTRACT

The present invention provides a combined package comprising a container and a mascara applicator. The applicator includes a hollow shaft having a longitudinal axis extending from the handle. A rod having a brush affixed at one end reciprocates within the hollow shaft. The rod has a first position and a second position such that when the handle of the applicator is secured to the container the rod reciprocates to the first position extending the hinge beyond the hollow shaft such that the brush is substantially non-aligned with the longitudinal axis of the hollow shaft. Upon removal of the applicator from the container the rod reciprocates to the second position causing the hinge to retract within the hollow shaft, thereby substantially aligning the brush with the longitudinal axis of the hollow shaft. This combined package allows the user to stir the product within the container when both attaching and removing the applicator to and from the container. The combined package also permits substantially all of the product to be removed from the container as the brush sweeps about the container.

12 Claims, 3 Drawing Sheets

COMBINED MASCARA BOTTLE AND APPLICATOR

FIELD OF THE INVENTION

The present invention relates to a combined mascara bottle and applicator, and more particularly, to such combined mascara bottles and applicators wherein the applicator includes a hinged reciprocal rod with a brush attached at one end such that the brush is in an extended, substantially horizontal position when placed within the bottle to allow the consumer to both stir the product within the bottle and deliver substantially all of the product to the brush.

BACKGROUND INFORMATION

Adjustable mascara applicators are well known in the art. Typically prior art adjustable mascara applicators include a handle portion having a hollow shaft attached thereto. A rod with a brush attached at its distal end reciprocates within the hollow shaft. The reciprocal rod is pre-bent which will allow the brush to assume various positions with respect to the handle portion of the applicator as the rod is reciprocated within the hollow shaft. When the handle portion of the applicator is secured to the bottle, the axis of the brush portion is substantially aligned with the hollow shaft. To use, the user removes the applicator from the bottle and adjusts the curvature of the brush prior to applying the mascara. After completing the application step the user straightens the brush portion aligning it with the hollow shaft and inserts the applicator into the bottle until the next application.

The prior art mascara bottles are typically cylindrical having an inside diameter only slightly larger than that of the brush. Therefore, the brush is limited to a reciprocating movement within the bottle as the user removes and inserts the brush for each application. While the reciprocal prior art mascara applicators have been found convenient and easy to use they are ineffective at preventing product from globbing or building up on the interior walls of the bottle. This is caused by the lack of mixing or stirring of product within the bottle. Furthermore, it is difficult to remove substantially all of the product from the prior art cylindrical bottles as the brush is unable to contact the product resting on the bottom of the bottle.

SUMMARY OF THE INVENTION

The present invention pertains, in a preferred embodiment to a combined package comprising a container and an applicator. The container has a circular base and a circular opening. Preferably, the dimension of the circular base is greater than the dimension of the circular opening. The opening of the container has an interior surface and an exterior surface. The exterior surface has a closure receiving means thereon. Preferably, the closure receiving means comprises threads. The applicator has a proximal end and a distal end. The proximal end has a handle attached thereto. The handle has an interior surface and an exterior surface. The interior surface includes means for securing the applicator to the closure receiving means of the container. Preferably, the closure receiving means includes threads. The applicator includes a hollow shaft having a longitudinal axis extending from the handle portion toward the distal end. A rod reciprocal within the hollow shaft has a proximal end and a distal end. The distal end includes a brush affixed thereto. The rod has flexible means positioned between the proximal end and the distal end. Preferably, the flexible means is a pre-bent section of resilient material. Most preferably, the flexible means is a hinge. The rod has a first position and a second position such that when the handle of the applicator is secured to the container the rod reciprocates to the first position extending the flexible means beyond the hollow shaft such that the brush is substantially non-aligned with the longitudinal axis of the hollow shaft. Preferably, the brush is substantially parallel to said base in said first position. Upon removal of the applicator from the container the rod reciprocates to the second position such that the flexible means retracts within the hollow shaft thereby substantially aligning the brush with the longitudinal axis of the hollow shaft.

BRIEF DESCRIPTION OF THE DRAWINGS

While the specification concludes with claims particularly pointing out and distinctly claim the invention, it is believed that the present invention will be better understood from the following description of preferred embodiments, taken in conjunction with the accompanying drawings, in which like reference numerals identify identical elements and wherein;

DETAILED DESCRIPTION OF THE INVENTION

Figure 1:
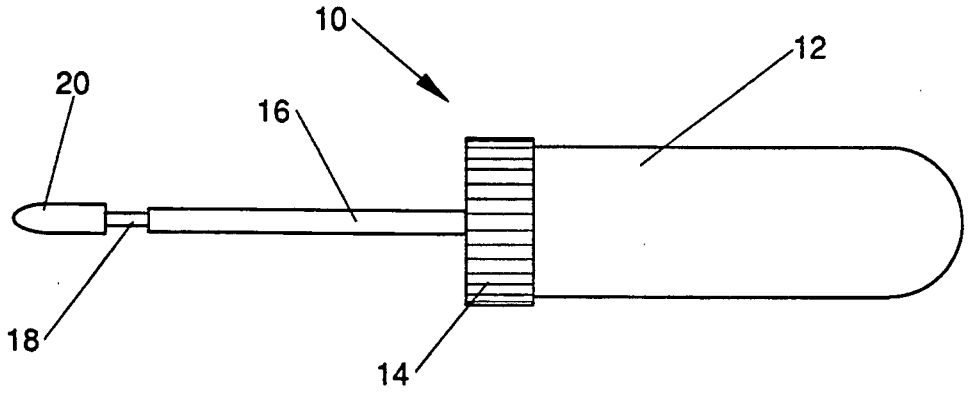
FIG. 1 is a planar view of a mascara applicator of the present invention.
Figure 2:
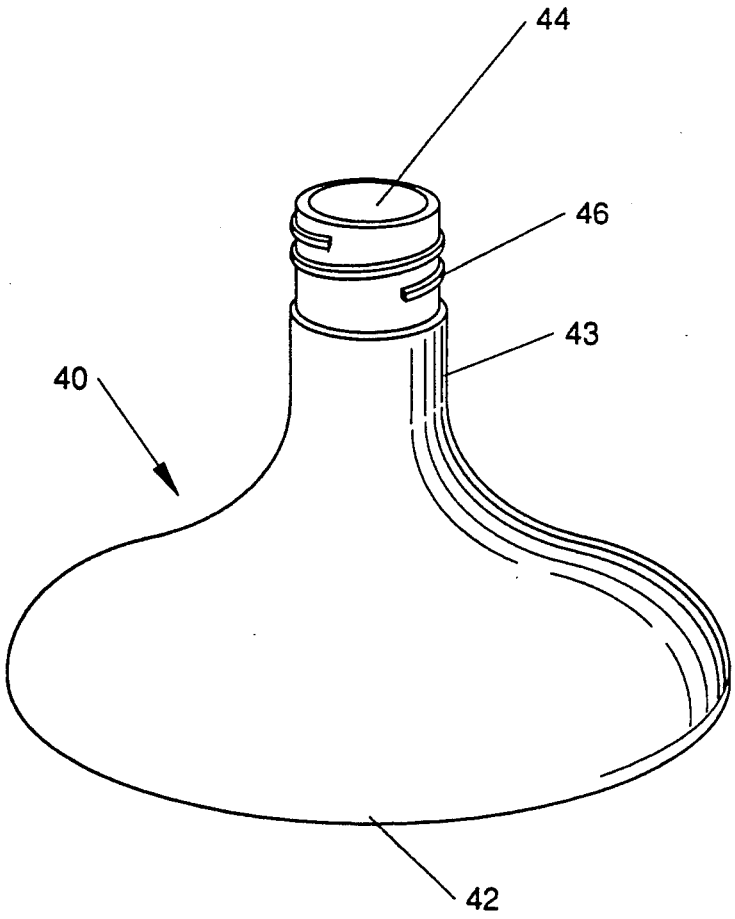
FIG. 2 is perspective view of a mascara bottle of the present invention.
Figure 3:
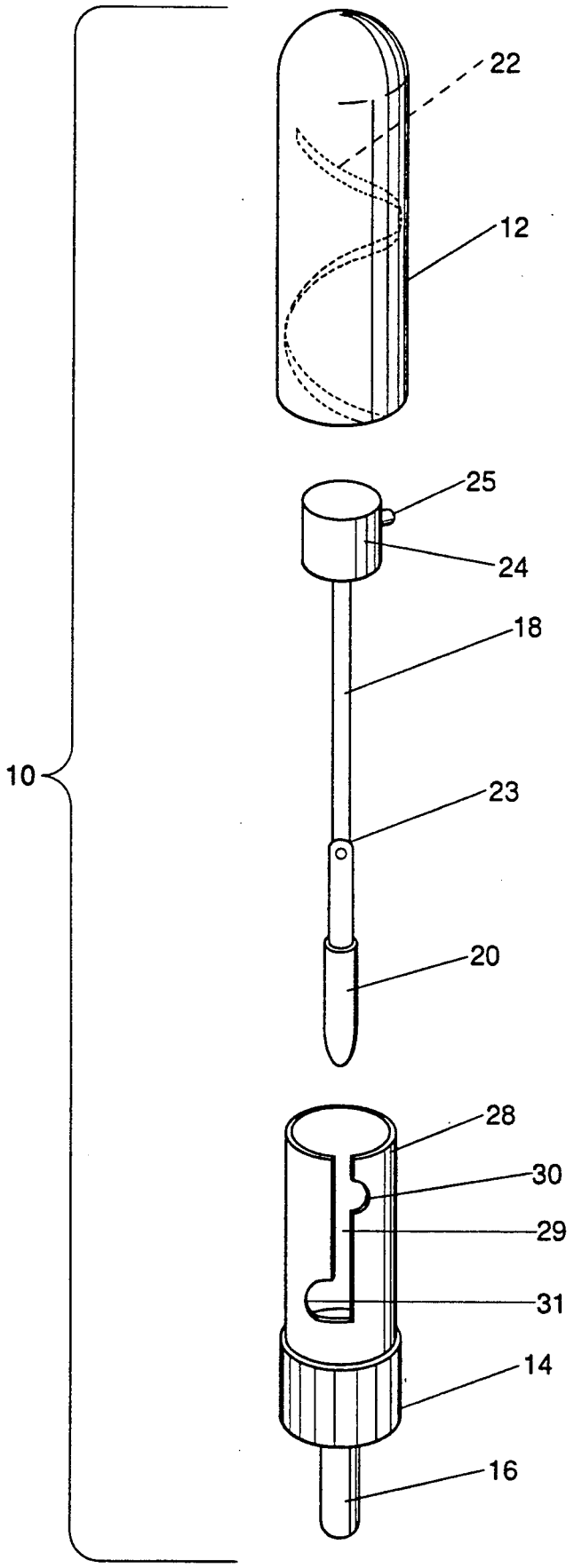
FIG. 3 is an exploded perspective view of the mascara applicator of FIG. 1.

In a particularly preferred embodiment, seen in FIGS. 1–3, the present invention provides a combined package comprising a mascara applicator indicated generally as 10 and a container or bottle indicated generally as 40. The applicator 10 comprises a combination cap and handle 12 at its first or proximal end. A closure section 14 having internal threads is attached to the handle section 12. A hollow shaft 16 extends from the closure section 14. The hollow shaft 16 extends towards the second or distal end of the applicator 10 along a generally longitudinal axis. Preferably, the longitudinal axis of the hollow shaft 16 is aligned with the longitudinal axis of the handle 12. A reciprocal rod 18 having a brush 20 attached at the distal or second end of the applicator 10 extends from the hollow shaft 16.

As shown in FIG. 2, the mascara bottle 40 of the present invention preferably has a generally circular shape as will be apparent from the description below. The base of the bottle 42 is preferably of a substantially greater diameter than the throat portion 43. The bottle has an opening 44 at the end of the throat section 43. Opening 44 is of such diameter that brush 20 and hollow shaft 16 may be inserted therethrough. The throat section 43 has external threads 46 near opening 44.

Referring now to FIG. 3, the mascara applicator 10 and mascara bottle 40 will be described in greater detail. An internal spiral cam 22 extends along the internal surface of the handle 12. Preferably, the internal spiral cam 22 comprises a notch or groove that has been molded or cut into the interior surface of the handle 12.

Reciprocal rod 18 includes flexible means 23 which allows the reciprocal rod 18 to flex or bend when the flexible means extends beyond the hollow shaft 16, as will be described in detail below. Preferably, the flexible means 23 is a hinge. Alternatively, the flexible means 23 may be a pre-bent section of resilient material or any other means known to allow flexing or bending of the reciprocal rod 18. The reciprocal rod 18 includes a brush 20 at its distal end. A preferred brush 20 is made from a bent wire that has a plurality of filaments secured to the wire by twisting the wire. The filaments are then trimmed to the desired cross-section, preferably circular. The brush may take on many other forms depending on the needs of manufacturer and the type of product applied. The choice and manufacture of the different brushes used on mascara applicators are well known to a person skilled in the art. Cylindrical knob 24 is located at the proximal end of reciprocal rod 18. Knob 24 includes a stem 25 attached thereto. Stem 25 on knob 24 interacts with internal spiral cam 22 to cause movement of the reciprocal rod 18 within hollow shaft 16 as the user turns handle 12.

Closure section 14 having internal threads (not shown) includes hollow shaft 16 in which reciprocal rod 18 is inserted. Extending in the opposite direction of hollow shaft 16 is hollow sleeve 28. Hollow sleeve 28 includes a track 29 having a first recess 30 and a second recess 31. Recesses 30 and 31 provide stopping points for stem 25 when the reciprocal rod 18 is in the fully extended or fully retracted position. Because recesses 30 and 31 remove stem 25 from the longitudinal axis of track 29 they prevent any movement of reciprocal rod 18 in and out of the hollow shaft while the stem 25 is locked into one of these positions.

To assemble mascara applicator 10 the brush or distal end of reciprocal rod 18 is inserted through hollow sleeve 28 and hollow shaft 16 of closure section 14. As the reciprocal rod 18 is inserted into hollow sleeve 28, stem 25 is aligned with track 29. Handle 12 is then secured over hollow sleeve 28 such that internal spiral cam 22 engages with stem 25.

Figure 4:
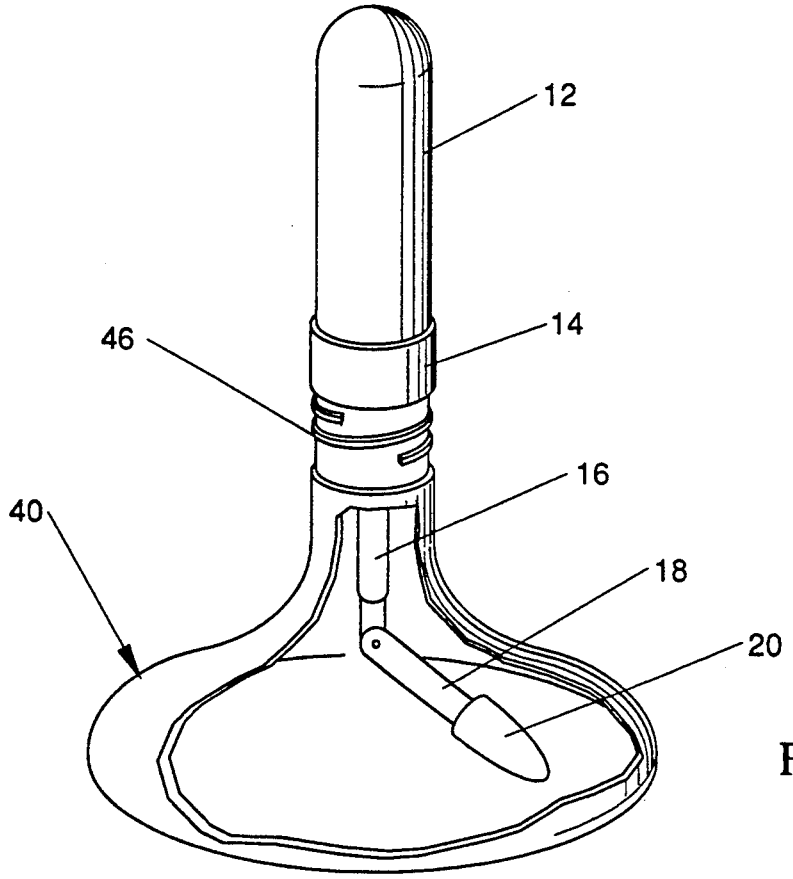
FIG. 4 is a planar view of the mascara bottle and applicator of FIGS. 1 and 2.

The operation of the combination package will now be described. FIG. 1 shows the applicator 10 with the reciprocal rod 18 in its retracted position. In the retracted position, hinge 23 of reciprocal rod 18 is positioned within hollow shaft 16. Thus, the brush 20 is substantially in alignment with the longitudinal axis of the hollow shaft 16. This position may be referred to as the use position as this is the position the applicator will be in when the user applies the mascara. When finished applying mascara the user will return the applicator 10 to the bottle 40. The user will insert brush 20 through opening 44 to engage the internal threads of closure section 14 with the external threads 46 on bottle 40. As the user turns the handle portion 12 in a clockwise direction, see FIG. 4, the internal threads of closure section 14 engage with the external threads 46. The force required to turn handle 12 is less than the force required to turn closure section 14 onto the external threads 46. Therefore, the first few turns of the handle 12 cause rotation of the handle 12 alone and little or no rotation of the closure section 14. The initial turns rotate the handle and stem 25 travels down track 29 as it moves within the internal spiral cam 22. As the stem 25 travels downward or toward the distal end, the reciprocal rod 18 extends from the hollow shaft 16. As the reciprocal rod 18 extends from hollow shaft 16 the hinge 23 is revealed. Once revealed from hollow shaft 16, the hinge 23 allows the reciprocal rod 18 to bend. As the hinge 23 bends the brush 20 becomes substantially non-aligned with the longitudinal axis of the hollow shaft 16. Once the reciprocal rod 18 has extended fully out of hollow shaft 16, further rotation of handle 12 causes closure section 14 to rotate onto the external threads 46 of the bottle 40, thereby securing the applicator 10 to the bottle 40.

Figure 5:
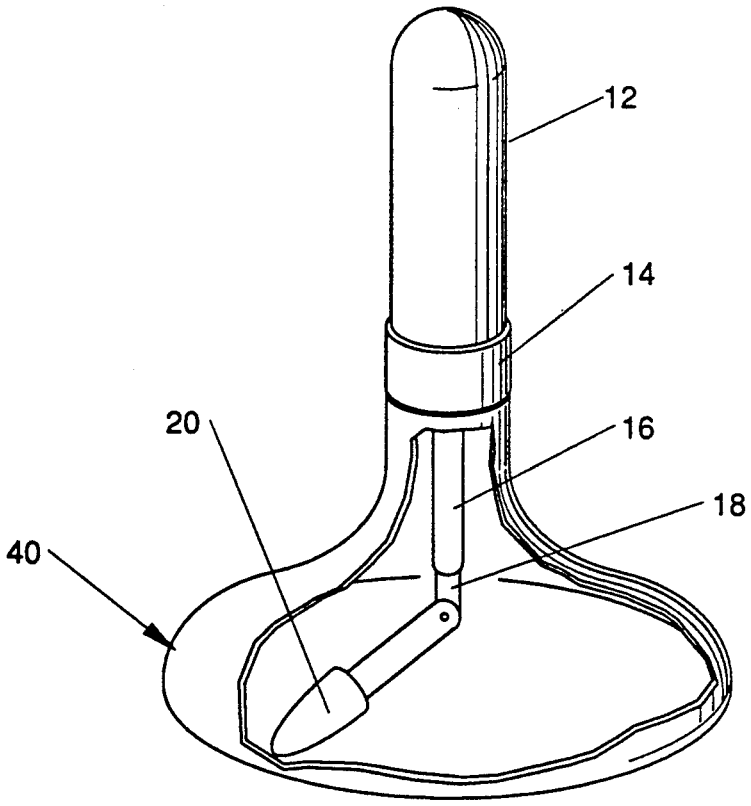
FIG. 5 is a planar view of the mascara bottle and applicator of FIG. 4.

As the applicator 10 is being secured to the bottle 40 the brush 20 moves in a clockwise sweeping motion about the base 42 of the bottle 40, see FIG. 5. As the brush sweeps about the base 42 it is substantially horizontal or parallel to the base 42. This substantially horizontal or parallel sweeping motion of brush 20 with respect to base 42 stirs the product housed within bottle 40. In addition, the sweeping action of brush 20 ensures that essentially all the product housed within bottle 40 will be retrieved by brush 20 as it sweeps along the base of the bottle 40.

It will be apparent from the above description of the need for bottle 40 to have a wide base in order to permit the sweeping motion of brush 20. If the bottle had a small diameter cylindrical shape similar to the bottles of the prior art, the brush would not be allowed to extend to the substantially horizontal position shown in FIG. 5. Instead, the brush would be limited to a substantially longitudinal orientation while positioned within the bottle. By extending to a substantially horizontal position as the brush sweeps about the base of bottle 40 more product is stirred and essentially all of the product may be retrieved from the bottle.

To remove applicator 10 from bottle 40 the user simply rotates the handle 12 in a counter clockwise direction. As the user rotates the handle in a counter clockwise direction, the first few turns cause the hinge 23 to move into the hollow shaft 16 as the stem 25 travels along internal spiral cam 22 toward the proximal end of handle 12. Additional turning of handle 12 causes the closure section 14 to disengage from the external threads 46 on bottle 40. As the user removes the applicator 10 from the bottle 40 the reciprocal rod 18 is in a fully retracted position as the hinge is then positioned within hollow shaft 16, as illustrated in FIG. 1. The steps recited above may be repeated until substantially all of the product has been emptied from the bottle 40.

While particular embodiments of the present invention have been illustrated and described, it would be obvious to those skilled in the art that various other changes and modifications may be made without departing from the spirit and scope of the present invention. The terms used in describing the present invention are used in their descriptive sense and not as terms of limitation, it being intended that all equivalents thereof be included within the scope of the appended claims.

What is claimed is:

1. A combined package comprising:

(a) a container for housing a liquid having a base and an opening, said opening having an interior surface and an exterior surface, said exterior surface having closure receiving means thereon;

(b) an applicator having a proximal end and a distal end, said proximal end having a handle attached thereto, said handle having an interior surface and an exterior surface, said interior surface having means for securing said applicator to said closure receiving means of said container, said applicator including:

(i) a hollow shaft having a longitudinal axis extending from said handle toward said distal end; and (ii) a rod reciprocal within said hollow shaft having a proximal end and a distal end, said distal end having a brush affixed thereto, said rod having flexible means positioned between said proximal end and said distal end, said rod having a first position and a second position, when said handle of said applicator is secured to said container said rod reciprocates to said first position extending said flexible means beyond said hollow shaft such that said brush is substantially non-aligned with said longitudinal axis of said hollow shaft, said brush stirring the liquid housed in said container as said handle of said applicator is secured to said container, upon removal of said applicator from said container said rod reciprocates to said second position such that said flexible means retracts within said hollow shaft thereby substantially aligning said brush with said longitudinal axis of said hollow shaft.

2. The combined package according to claim 1 wherein said flexible means is a hinge.

3. The combined package according to claim 1 wherein said flexible means is a pre-bent section of resilient material.

4. The combined package according to claim 1 wherein said base and said opening of said container are substantially circular.

5. The combined package according to claim 4 wherein the circular dimension of said base is greater than the cicular dimension of said opening.

6. The combined package according to claim 1 wherein said brush is substantially parallel to said base in said first position.

7. the combined package according to claim 1 wherein said closure receiving means of said container comprises threads.

8. The combined package according to claim 1 wherein said means for sacuring said applicator to said closure receiving means of said container comprises threads.

9. A combined package comprising:

(a) a container for housing a liquid having a base and an opening, said opening having an interior surface and an exterior surface, said exterior surface having closure receiving means thereon;

(b) an applicator having a proximal end and a distal end, said proximal end having a handle attached thereto, said handle having an interior surface and an exterior surface, said interior surface having means for securing said applicator to said closure receiving means of said container, said applicator including:

(i) a hollow shaft having a longitudinal axis extending from said handle toward said distal end; and (ii) a rod reciprocal within said hollow shaft having a proximal end and a distal end, said distal end having a brush affixed thereto, said rod having a hinge positioned between said proximal end and said distal end, said rod having a first position and a second position, when said handle of said applicator is secured to said container said rod reciprocates to said first position extending said hinge beyond said hollow shaft such that said brush is substantially parallel to said base of said container, said brush stirring the liquid housed in said container as said handle of said applicator is secured to said container, upon removal of said applicator from said container said rod reciprocates to said second position such that said hinge retracts within said hollow shaft thereby substantially aligning said brush with said longitudinal axis of said hollow shaft.

10. The combined package according to claim 9 wherein said base and said opening of said container are substantially circular.

11. The combined package according to claim 10 wherein the circular dimension of said base is greater than the circular dimension of said opening.

12. The combined package according to claim 7 wherein said brush is substantially horizontal in said first position.

* * * * *